US010612866B2

(12) United States Patent
Wu et al.

(10) Patent No.: US 10,612,866 B2
(45) Date of Patent: Apr. 7, 2020

(54) MICRO-CHANNEL HEAT EXCHANGER

(71) Applicant: ZHEJIANG DUNAN THERMAL TECHNOLOGY CO., LTD, Shaoxing, Zhejiang (CN)

(72) Inventors: Qinghao Wu, Zhejiang (CN); Jun Jiang, Zhejiang (CN); Huangang Yu, Zhejiang (CN)

(73) Assignee: ZHEJIANG DUNAN THERMAL TECHNOLOGY CO., LTD, Shaoxing (CN)

( * ) Notice: Subject to any disclaimer, the term of this patent is extended or adjusted under 35 U.S.C. 154(b) by 207 days.

(21) Appl. No.: 15/594,685

(22) Filed: May 15, 2017

(65) Prior Publication Data

US 2017/0328638 A1 Nov. 16, 2017

(30) Foreign Application Priority Data

May 13, 2016 (CN) ..... 2016 1 0318160

(51) Int. Cl.

| | |
|---|---|
| ***F28F 1/02*** | (2006.01) |
| ***F28F 9/02*** | (2006.01) |
| ***F28D 1/053*** | (2006.01) |

(52) U.S. Cl.

CPC ..... *F28F 9/0273* (2013.01); *F28D 1/05383* (2013.01); *F28F 9/0221* (2013.01); *F28F 9/0243* (2013.01); *F28F 9/0278* (2013.01); *F28F 2260/02* (2013.01)

(58) Field of Classification Search

CPC ..... F28F 1/022; F28F 9/0221; F28F 9/0273; F28F 9/0278; F28F 25/04; F28F 2260/02; F28D 7/16; F28D 7/1653; F28D 1/05383

See application file for complete search history.

(56) References Cited

U.S. PATENT DOCUMENTS

| | | | | |
|---|---|---|---|---|
| 2002/0066554 | A1* | 6/2002 | Oh | F28D 1/0535 165/179 |
| 2002/0088612 | A1* | 7/2002 | Gotou | F28D 9/0062 165/166 |
| 2009/0236086 | A1* | 9/2009 | Higashiyama | F25B 39/02 165/176 |
| 2009/0266104 | A1* | 10/2009 | Ichiyanagi | F25B 39/00 62/498 |
| 2012/0298332 | A1* | 11/2012 | Petters | F28D 21/0015 165/104.11 |
| 2014/0224462 | A1* | 8/2014 | Kamada | F28F 1/022 165/181 |

(Continued)

*Primary Examiner* — Tho V Duong

(57) ABSTRACT

The invention involves a micro-channel heat exchanger, which includes flat tubes (8), fins (9) and plate-type header pipes communicated with the flat tubes, (8) each plate-type header pipe comprising a flat tube groove plate, a distribution plate (2) and an outer side sealing plate (5), a plurality of flat tube groove through holes (3) are provided in the flat tube groove plate (1) along a length direction, throttling channels (4) communicated with the flat tube groove through holes (3) are provided in the distribution plate (2) along an arrangement direction of the flat tube groove through holes (3), the outer side sealing plate (5) is provided on one side, far away from the flat tube groove plate (1), of the distribution plate (2). The micro-channel heat exchanger can solve the problems of low heat exchange efficiency and small heat exchange area of the heat exchanger.

3 Claims, 10 Drawing Sheets

(56) References Cited

U.S. PATENT DOCUMENTS

2014/0318749 A1* 10/2014 Katoh ..... B60H 1/00328
165/140
2015/0338173 A1* 11/2015 Katoh ..... F28F 9/0278
165/172

* cited by examiner

MICRO-CHANNEL HEAT EXCHANGER

CROSS REFERENCE TO RELATED APPLICATION

This application claims priority to Chinese Patent Application No. 201610318160.X, filed on May 13, 2016, the entire contents of which are incorporated herein by reference.

FIELD OF THE INVENTION

The present invention relates to a heat exchanger assembled and used in an air conditioner, a refrigerator, a heat pump or the like, in particular to a micro-channel heat exchanger.

BACKGROUND OF THE INVENTION

The existing micro-channel heat exchanger usually consists of three major parts, i.e., flat tubes, fins and header pipes, wherein the header pipes are usually round and are mainly used for distributing and collecting refrigerant in the flat tubes.

Since the internal spaces of the round header pipes are relatively great, gas refrigerant and liquid refrigerant inside the round header pipes are caused to be separated, consequently the uniform distribution of the refrigerant in the flat tubes is seriously influenced, and usually liquid distribution devices (such as liquid distribution pipes) need to be added to uniformly distribute the refrigerant into each flat tube. Moreover, when the windward size of the micro-channel heat exchanger is limited, the header pipe as a non-heat-exchange unit will occupy certain area, consequently the area of a heat exchange zone is decreased and the heat exchange efficiency of the heat exchanger is reduced; and especially when the flat tubes are relatively wide, the diameter of the header pipe will be increased correspondingly, consequently the cost is increased and the heat exchange area is further decreased.

SUMMARY OF THE INVENTION

The purpose of the present invention is to provide a micro-channel heat exchanger, so as to solve the problems of low heat exchange efficiency and small heat exchange area of the heat exchanger in the prior art.

In order to solve the above-mentioned technical problems, in one aspect of the present invention, the present invention provides a micro-channel heat exchanger, comprising flat tubes, fins and plate-type header pipes communicated with the flat tubes, wherein each of the plate-type header pipes comprises a flat tube groove plate and a distribution plate, a plurality of flat tube groove through holes are provided in the flat tube groove plate along a length direction, and throttling channels communicating the plurality of flat tube groove through holes are provided in the distribution plate; each of the plate-type header pipe further comprises an outer side sealing plate, and the outer side sealing plate is provided on one side, far away from the flat tube groove plate, of the distribution plate; and the outer side sealing plate comprises a protruding channel extending along an arrangement direction of the throttling channels, and the protruding channel is communicated with the throttling channels in the same column.

In a specific implementation mode, a spacing plate is provided between the distribution plate and the flat tube groove plate, and distribution channels (11) communicating the throttling channels with the flat tube groove through holes are provided in the spacing plate.

As a further preferred implementation mode, the flat tube groove through holes, the distribution channels and the throttling channels are provided in a single column.

As another further preferred implementation mode, the flat tube groove through holes are provided in double columns, the distribution channels are provided in a single column and the throttling channels are provided in a single column or double columns.

As another further preferred implementation mode, the flat tube groove through holes (3) and the distribution channels (11) are provided in double columns, and the throttling channels are provided in a single column or double columns.

As another further preferred implementation mode, the flat tube groove through holes are provided in three columns, the distribution channels are provided in a single column, double columns or three columns, and the throttling channels are provided in a single column, double columns or three columns.

As a preferred one of the above-mentioned implementation modes, the number of rows of the flat tube groove through holes communicated with each of the distribution channels is the same.

As another preferred one of the above-mentioned implementation modes, the number of rows of the flat tube groove through holes communicated with each of the distribution channels is different from the number of rows of the flat tube groove through holes communicated with the adjacent distribution channel.

Further, the number of rows of the flat tube groove through holes communicated with each of the distribution channels is the same as the number of rows of the flat tube groove through holes communicated with the distribution channel in the row spaced by one row.

In a specific implementation mode, the flat tube groove through holes are provided in three columns, the distribution channels are provided in two columns, the throttling channels are provided in a single column, the distribution channels in one column are communicated with the flat tube groove through holes in two columns, each of the distribution channels in the column is communicated with two flat tube groove through holes in at least the same row, the distribution channels in the other column are communicated with the flat tube groove through holes in a third column, and the throttling channels are communicated with the distribution channels in the other column.

According to the micro-channel heat exchanger provided by the present invention, since each of the plate-type header pipe comprises a flat tube groove plate and a distribution and the round header pipes are manufactured into a structure consisting of a plurality of plates which are stacked, the space can be saved, the cost is reduced, the manufacturing difficulty is reduced, the proportion of the windward area occupied by the header pipes is reduced, the area of the non-heat-exchange unit can be decreased, the proportion of the heat exchange area occupied in the heat exchanger is increased and the heat exchange efficiency of the heat exchanger is improved.

Figure 1:
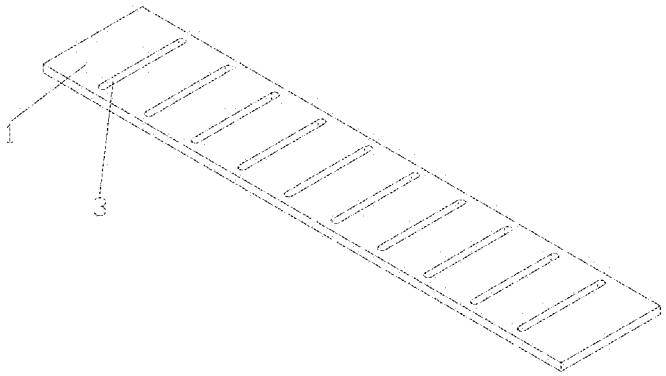
FIG. 1 schematically illustrates a stereoscopic structural view of a first-type flat tube groove plate of a micro-channel heat exchanger according to embodiment 1 of the present invention.

Description of reference signs in drawings: 1—flat tube groove plate; 2—distribution plate; 3—flat tube groove through hole; 4—throttling channel; 5—outer side sealing plate; 6—toothed groove; 7—protruding channel; 8—flat tube; 9—fin; 10—spacing plate; 11—distribution channel; 12—connecting rib

DESCRIPTION OF THE EMBODIMENTS

The embodiments of the present invention will be described below in detail. However, the present invention may be implemented through various different modes defined and covered by claims.

Please refer to FIG. 1-19. According to the embodiments of the present invention, a micro-channel heat exchanger comprises flat tubes 8, fins 9 and plate-type header pipes communicated with the flat tubes 8, each of the plate-type header pipes comprises a flat tube groove plate 1, a distribution plate 2 and an outer side sealing plate 5, a plurality of flat tube groove through holes 3 are provided in the flat tube groove plate 1 along a length direction, throttling channels 4 communicated with the flat tube groove through holes 3 are provided in the distribution plate 2 along an arrangement direction of the flat tube groove through holes 3, the outer side sealing plate 5 is provided on one side, far away from the flat tube groove plate 1, of the distribution plate 2, the outer side sealing plate 5 comprises a protruding channel 7 extending along an arrangement direction of the throttling channels 4, and the protruding channel 7 is communicated with at least part of the throttling channels 4 in the same column. The throttling channels 4 can play a role of effective throttling, balance resistance of refrigerant flowing through each flat tube, enable this resistance to be consistent as much as possible to achieve the purpose of uniform distribution, and improve the heat exchange efficiency between the refrigerant and the flat tubes 8.

The outer side sealing plate 5 can form a sealing structure for the outer side, far away from the flat tube groove plate, of the distribution plate 2, such that the structural design of the distribution plate 2 can be more diversified, the manufacturing difficulty of the distribution plate 2 is reduced, the distribution plate 2 and the flat tube groove plate 1 can be effectively guaranteed to be in sealing fit, and the flowing performance of the refrigerant between the distribution plate 2 and the flat tube groove plate 1 is improved.

By adopting the plate-type header pipe in the present invention, since the round header pipe is manufactured into a structure consists of a plurality of plates which are stacked, the space can be saved, the cost is reduced, the manufacturing difficulty is reduced, the area of the non-heat-exchange unit can be decreased, the proportion of the heat exchange area occupied in the heat exchanger is increased and the heat exchange efficiency of the heat exchanger is improved.

As illustrated in FIG. 1-10, the flat tube groove through holes 3 of the micro-channel heat exchanger may be provided in a single column, double columns or more columns, and may be specifically designed according to the needs.

As illustrated in FIG. 1, in a first-type structure of the flat tube groove plate 1, flat tube groove through holes 3 in a column are provided in the flat tube groove plate along a length direction, the flat tube groove through holes 3 in this column are communicated with the throttling channels 4 in the distribution plate 2 such that the refrigerant can be equally distributed in each of the flat tube groove through holes 3 after the refrigerant passes through the distribution plate 2 and the refrigerant is equally distributed in each of the flat tubes by using each of the flat tube groove through holes 3. The flat tubes penetrate through the flat tube groove through holes 3 and are communicated with one another through the throttling channels 4 in the distribution plate 2, such that the refrigerant can be uniformly distributed in each of the flat tubes which penetrate through the flat tube groove through holes after the refrigerant is distributed through the distribution plate 2.

Figure 2:
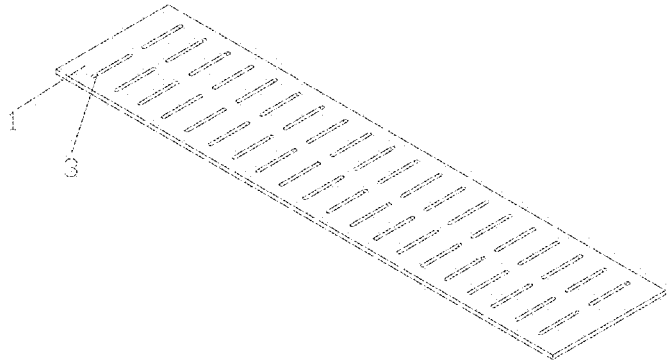
FIG. 2 schematically illustrates a stereoscopic structural view of a second-type flat tube groove plate of a micro-channel heat exchanger according to embodiment 1 of the present invention.

As illustrated in FIG. 2, in a second-type structure of the flat tube groove plate 1, flat tube groove through holes 3 in double columns are provided in the flat tube groove plate 1 along a length direction, and the flat tube groove through holes 3 in the two columns are correspondingly abreast provided one to one. Specifically, centerlines of two flat tube groove through holes 3 in the same row in the flat tube groove through holes 3 in the double columns are located on the same line in a width direction of the flat tube, and two flat tube groove through holes 3 in the same row are provided in a spaced manner. This structure can realize the collection and distribution of the refrigerant in the flat tubes in the double columns, and can improve the heat exchange efficiency of the refrigerant.

Figure 3:
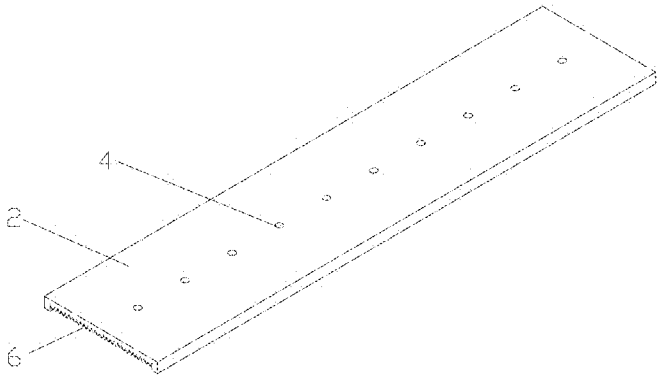
FIG. 3 schematically illustrates a stereoscopic structural view of a first-type distribution plate of a micro-channel heat exchanger according to embodiment 1 of the present invention.
Figure 4:
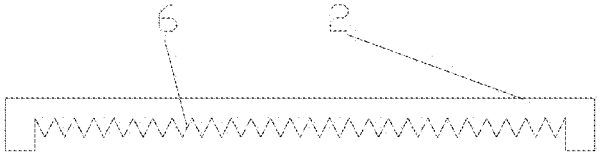
FIG. 4 schematically illustrates a front view of a first-type distribution plate of a micro-channel heat exchanger according to embodiment 1 of the present invention.
Figure 5:
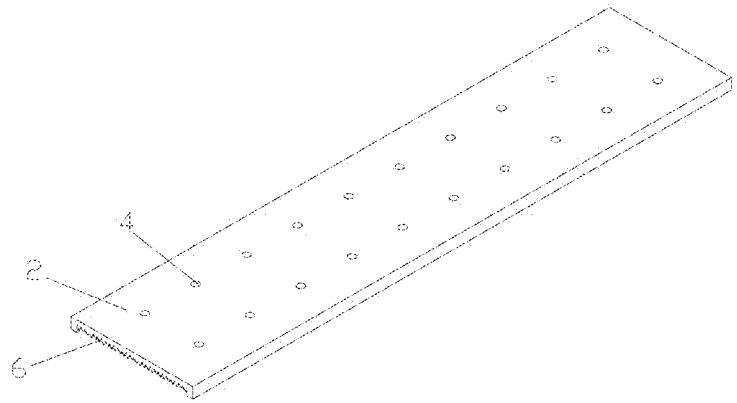
FIG. 5 schematically illustrates a stereoscopic structural view of a second-type distribution plate of a micro-channel heat exchanger according to embodiment 1 of the present invention.

As illustrated in FIG. 3-5, toothed grooves 6 extending along a length direction of the distribution plate 2 are provided in one side, facing to the flat tube groove plate, of the distribution plate, and the throttling channels run through a bottom plate of the toothed grooves 6. The toothed grooves 6 can assist the distribution plate 2 to form a plurality of refrigerant circulation channels, and by using the change of the resistance of the circulation channels formed by the toothed grooves 6 and the resistance of the throttling channels 4, the flowing resistance of each flat tube can be balanced and the uniform distribution of the refrigerant is guaranteed. Moreover, since the hydraulic diameter of the circulation channels of the toothed grooves 6 is small, gas and liquid mixed refrigerant is not easily separated in a narrow space and the uniform distribution of the refrigerant is further facilitated.

The section of the toothed groove 6 is triangular, trapezoidal, rectangular or arc-shaped, and the section of the toothed groove 6 may also be sine wave-shaped or cosine wave-shaped.

The throttling channels 4 comprise distribution holes or distribution grooves which are provided corresponding to the flat tube groove through holes 3.

As illustrated in FIG. 3 and FIG. 4, a first-type structure of the distribution plate 2 comprises distribution holes in a single column which are provided corresponding to the first-type flat tube groove plate 1, a plurality of distribution holes are provided in a spaced manner along the length direction of the distribution plate 2, and the distribution holes are provided corresponding to the flat tube groove through holes 3 in the flat tube groove plate 1 one to one, such that the distribution plate 2 can be communicated with each of the flat tube groove through holes 3 through the distribution holes. Of course, each of the distribution holes and the flat tube groove through holes 3 in the flat tube groove plate 1 may also be adjusted according to the actual needs. For example, each of the distribution holes is provided corresponding to a plurality of flat tube groove through holes 3.

As illustrated in FIG. 5, a second-type structure of the distribution plate 2 comprises distribution holes in double columns which are provided corresponding to the second-type flat tube groove plate 1, and the distribution holes are provided corresponding to the flat tube groove through holes 3 one to one. Each of the distribution holes and the flat tube groove through holes 3 in the flat tube groove plate 1 may also be adjusted according to the actual needs. For example, each of the distribution holes is provided corresponding to a plurality of flat tube groove through holes 3.

Of course, since the circulation channels are formed between the distribution plate 2 and the flat tube groove plate 1 through the toothed grooves 6, the refrigerant firstly enters the circulation channels and then is distributed through the distribution holes. Therefore, the distribution holes may also be arranged according to the needs and are provided not corresponding to the flat tube groove through holes 3 in the flat tube groove plate 1 one to one. Thereby, the distance between the distribution holes, the diameter of the distribution holes, the number of rows of the distribution holes and the like maybe flexibly adjusted, the distribution holes can be arranged in a structure which more greatly facilitates the uniform distribution of the refrigerant, and thus the equal distribution effect of the refrigerant in the plate-type header pipe is further improved.

Figure 6:
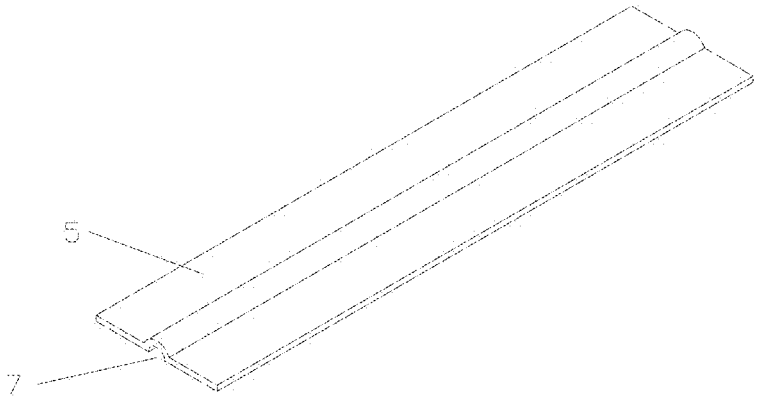
FIG. 6 schematically illustrates a stereoscopic structural view of a first-type outer side sealing plate of a micro-channel heat exchanger according to embodiment 1 of the present invention.
Figure 7:
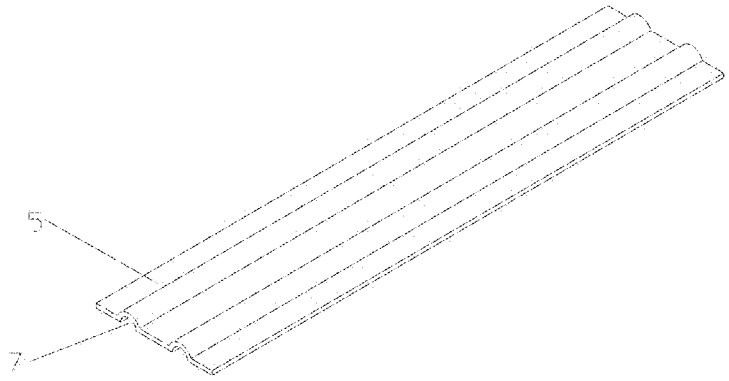
FIG. 7 schematically illustrates a stereoscopic structural view of a second-type outer side sealing plate of a micro-channel heat exchanger according to embodiment 1 of the present invention.
Figure 8:
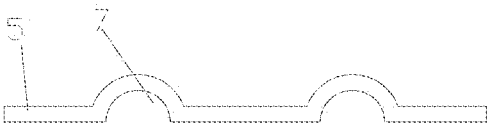
FIG. 8 schematically illustrates a front view of a second-type outer side sealing plate of a micro-channel heat exchanger according to embodiment 1 of the present invention.

As illustrated in FIG. 6-8, the outer side sealing plate 5 comprises a protruding channel 7 extending along an arrangement direction of the throttling channels 4, and the protruding channel 7 is communicated with the throttling channels 4 in the same column.

As illustrated in FIG. 6, in a first-type structure of the outer side sealing plate 5, the outer side sealing plate 5 comprises a protruding channel 7 extending in an arrangement direction of the throttling channels 4, and the protruding channel 7 corresponds to the position of the throttling channels 4 in the first-type distribution plate 2 in a width direction, such that the throttling channels 4 can be communicated through the protruding channel 7.

As illustrated in FIG. 7 and FIG. 8, in a second-type structure of the outer side sealing plate 5, the outer side sealing plate 5 comprises two protruding channels 7 extending in an arrangement direction of the throttling channels 4, and the two protruding channels 7 in the outer side sealing plate 5 are provided corresponding to two columns of throttling channels 4 in the second-type distribution plate 2, such that each of the protruding channels 7 can be communicated with the throttling channels 4 in the corresponding column. The protruding channels 7 in the heat exchanger can play a role of guiding the refrigerant to flow into and out of the heat exchanger.

Specifically, the protruding channels 7 are arc-shaped grooves which protrude from the outer side sealing plate 5 to a direction far away from the distribution plate 2, and thereby the flowing resistance of the refrigerant in a flowing process can be decreased. Of course, the shape of the protruding channels 7 may also be a rectangular shape, a triangular shape or the like.

Figure 14:
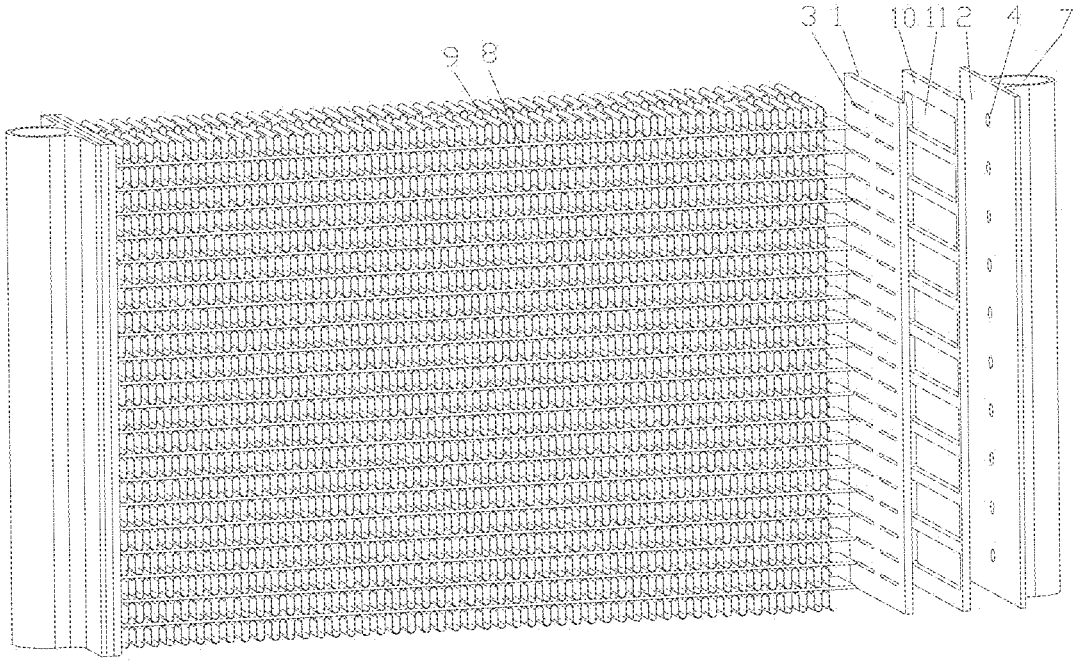
FIG. 14 schematically illustrates an exploded structural view of a micro-channel heat exchanger according to embodiment 5 of the present invention.
Figure 15:
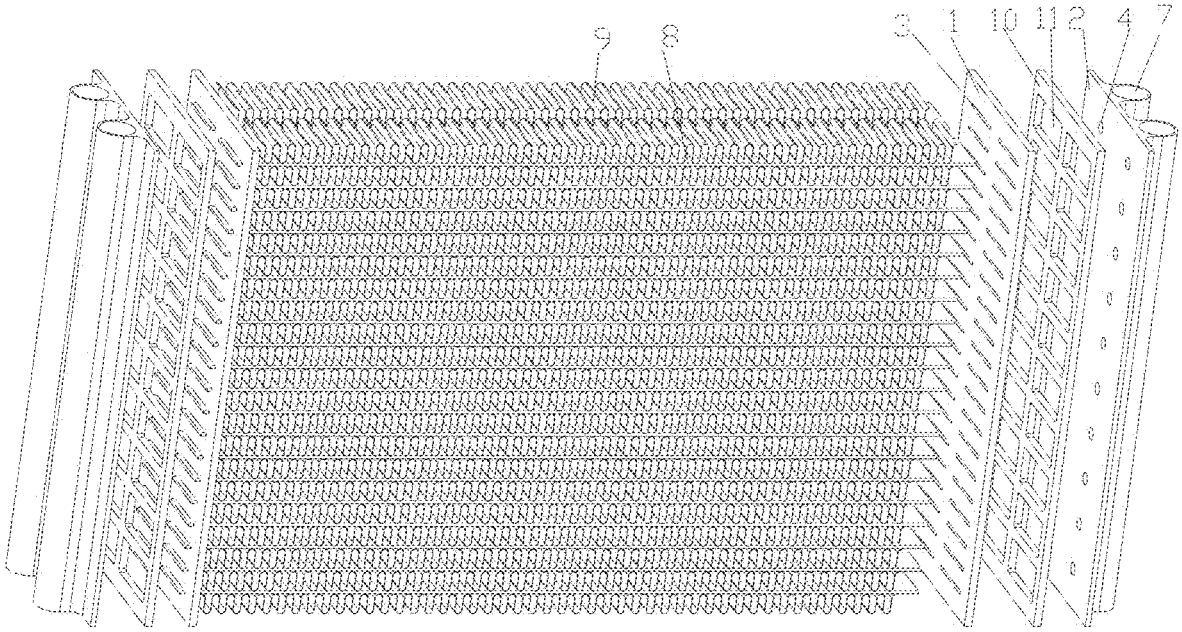
FIG. 15 schematically illustrates an exploded structural view of a micro-channel heat exchanger according to embodiment 6 of the present invention.
Figure 18:
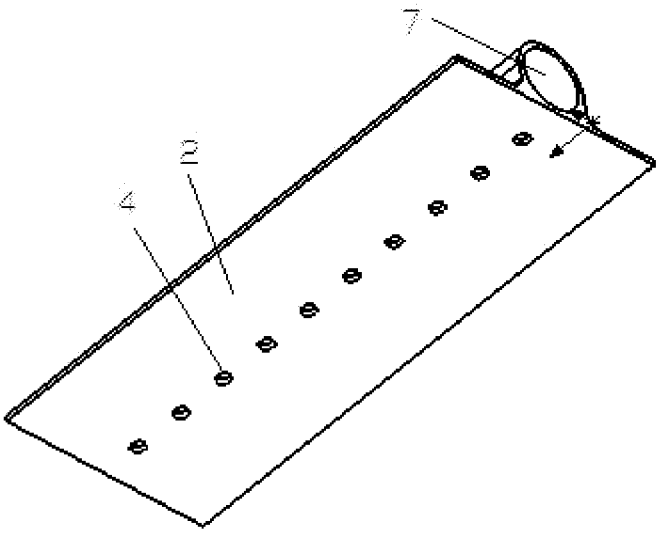
FIG. 18 schematically illustrates a stereoscopic structural view of first-type distribution plate and outer side sealing plate integration of a micro-channel heat exchanger according to the present invention.
Figure 19:
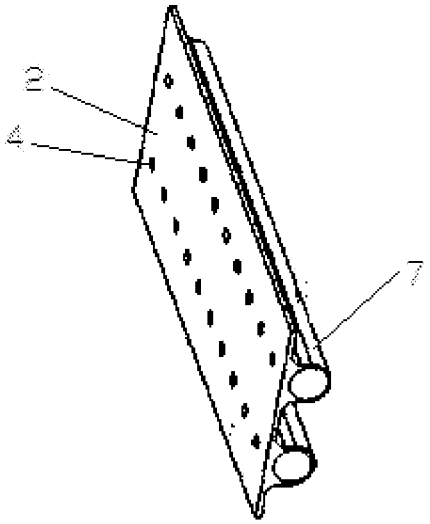
FIG. 19 schematically illustrates a stereoscopic structural view of second-type distribution plate and outer side sealing plate integration of a micro-channel heat exchanger according to the present invention.

As illustrated in FIG. 18 and FIG. 19, according to the embodiment of the present invention, the distribution plate 2 and the outer side sealing plate 5 are integrally molded, the distribution plate 2 comprises throttling channels 4 and a protruding channel 7 which communicates the throttling channels 4, and the protruding channel 7 extends along a length direction of the distribution plate 2 and is used as an outlet and an inlet of refrigerant. A difference between FIG. 14 and FIG. 15 lies in that the plate-type header pipe in FIG. 14 is suitable for flat tubes in a single row while the plate-type header pipe in FIG. 15 is suitable for flat tubes in double rows. Each of the throttling channels 4 in the distribution plate 2 may be communicated with the flat tubes in a single row and may also be simultaneously communicated with a plurality of flat tubes in a plurality of rows. As illustrated in FIG. 15, by taking flat tubes in double rows as an example, when each of the throttling channels 4 in the distribution plate 2 is communicated with flat tubes in two rows, if the refrigerant enters a cavity formed by one throttling channel 4 and the flat tubes through the throttling channel 4, the refrigerant will be distributed according to the need of each flat tube, thereby the on-demand distribution of the refrigerant is realized and the heat exchange efficiency of the refrigerant is improved. The mode of communication between the throttling channels 4 and the flat tubes may also be that adjacent throttling channels 4 respectively correspond to different numbers of flat tubes.

Figure 9:
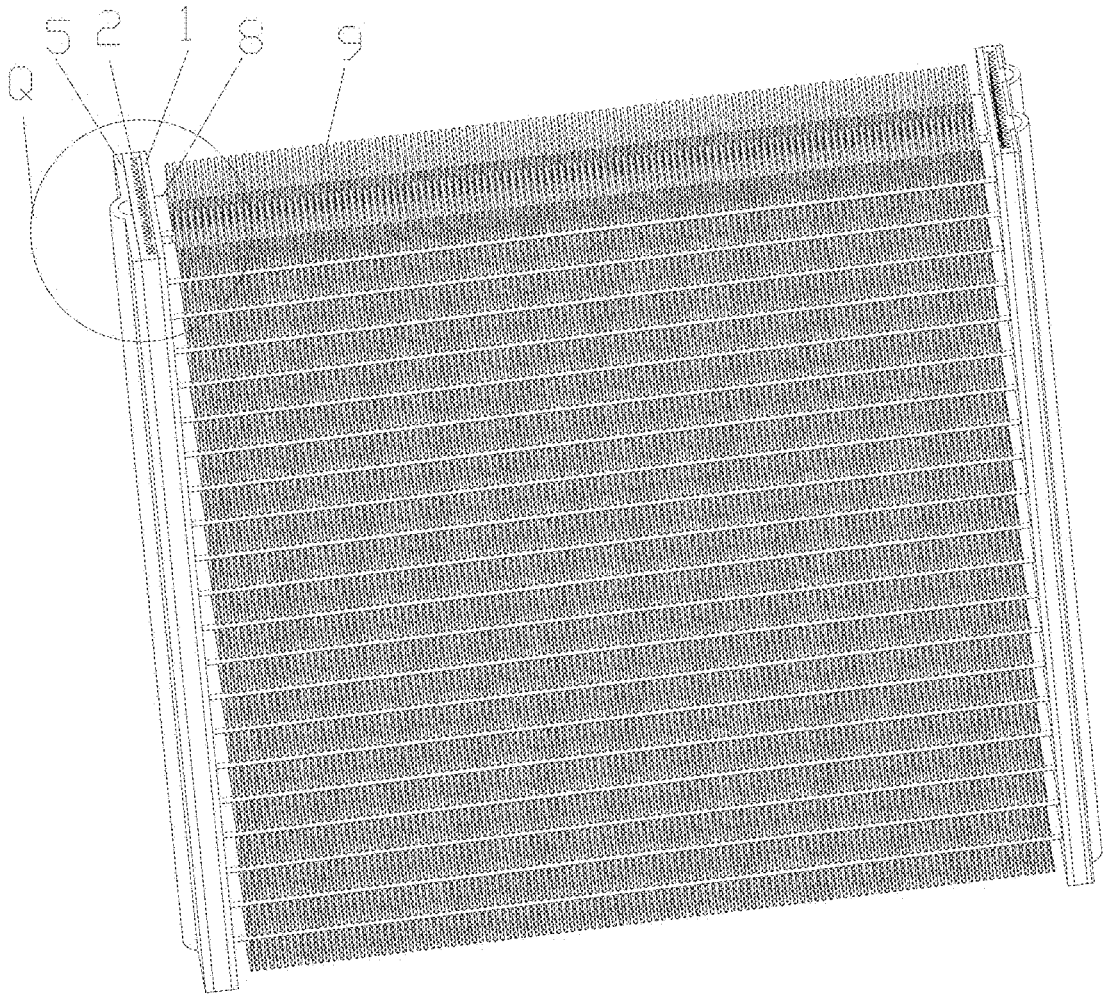
FIG. 9 schematically illustrates a stereoscopic structural view of a micro-channel heat exchanger according to embodiment 1 of the present invention.
Figure 10:
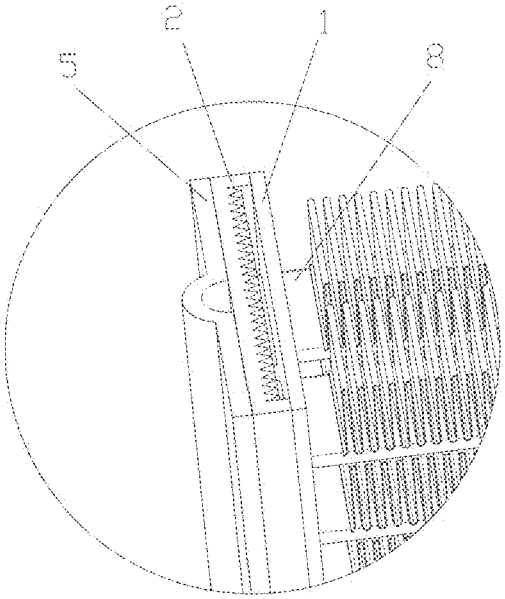
FIG. 10 illustrates an enlarged structural view of position Q in FIG. 9.

As illustrated in FIG. 9 and FIG. 10, a plate-type header pipe according to embodiment 1 of the present invention comprises a flat tube groove plate 1 having flat tube groove through holes 3 in a single column, a distribution plate 2 having distribution holes in a single column and an outer side sealing plate having a protruding channel 7. The three plates are closely sealed and combined together. The refrigerant firstly enters the protruding channel 7, then is uniformly distributed through the distribution holes in the distribution plate 2 in a process of flowing in the protruding channel 7, then enters circulation channels formed by toothed grooves 6 in the distribution plate 2 and the flat tube groove plate 1 and flows in the circulation channels. Since the section size (hydraulic diameter) of the toothed grooves 6 is small, gas-liquid separation can be effectively avoided.

After the refrigerant is uniformly mixed through the resistance of the toothed grooves 6, the refrigerant is distributed into the corresponding flat tubes through the flat tube groove through holes 3 for heat exchange.

Of course, in other embodiments, the plate-type header pipe may also comprise a flat tube groove plate 1 having flat tube groove through holes 2 in double columns, a distribution plate 2 having distribution holes in double columns and an outer side sealing plate having two protruding channels 7, or the throttling channels 4 in the distribution plate 2 may also be arranged as communicating grooves such that the communicating grooves in one column are communicated with the flat tube groove through holes 3 in double columns, or other combination modes may also be adopted. For example, flat tube groove through holes in double columns are matched with distribution holes in double columns and then are matched with a single protruding channel.

As illustrated in FIG. 11-17, according to the embodiment of the present invention, a spacing plate 10 is provided between the distribution plate 2 and the flat tube groove plate 1, and distribution channels 11 communicating the throttling channels 4 with the flat tube groove through holes 3 are provided in the spacing plate 10. The distribution channels 11 may redistribute two-phase refrigerant formed after throttling performed by the throttling channels 4, such that the two-phase refrigerant can be more uniformly distributed into each of the flat tube groove through holes 3 in the flat tube groove plate 1, the refrigerant can be uniformly mixed and distributed, the heat exchange efficiency between the refrigerant and the flat tubes is improved and the heat exchange performance of the micro-channel heat exchanger is improved.

Matching modes of the flat tube groove through holes 3, the distribution channels 11 and the throttling channels 4 may be various. For example, the flat tube groove through holes 3, the distribution channels 11 and the throttling channels 4 are all provided in a single column; or the flat tube groove through holes 3 are provided in two columns, the distribution channels 11 are provided in a single column and the throttling channels 4 are provided in a single column or double columns; or the flat tube groove through holes 3 and the distribution channels 11 are provided in double columns and the throttling channels 4 are provided in a single column or double columns; or the flat tube groove through holes 3 are provided in three columns, the distribution channels 11 are provided in a single column, double columns or three columns, and the throttling channels 4 are provided in a single column, double columns or three columns.

In one implementation mode, the number of rows of the flat tube groove through holes 3 communicated with each of the distribution channels 11 is the same.

In another implementation mode, the number of rows of the flat tube groove through holes 3 communicated with each of the distribution channels 11 is different from the number of rows of the flat tube groove through holes 3 communicated with the adjacent distribution channel 11, and the number of rows of the flat tube groove through holes 3 communicated with each of the distribution channels is the same as the number of rows of the flat tube groove through holes 3 communicated with the distribution channel 11 in the row spaced by one row.

Figure 11:
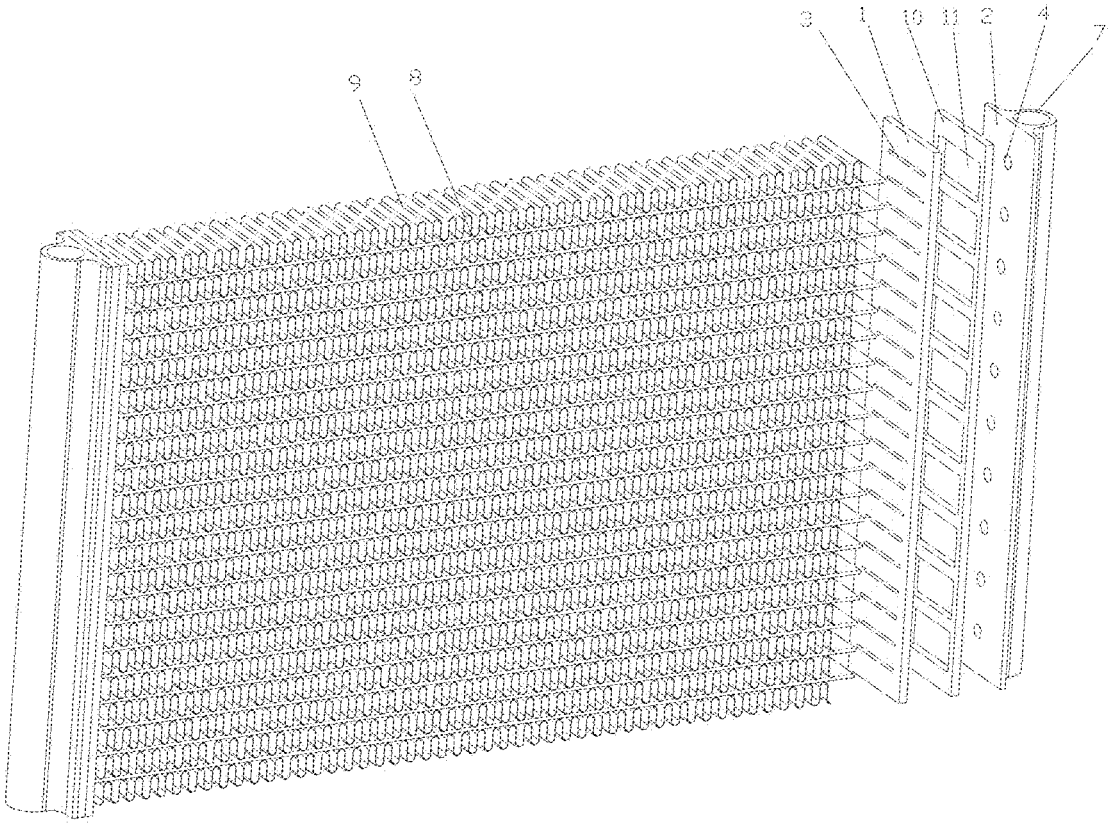
FIG. 11 schematically illustrates a stereoscopic structural view of a micro-channel heat exchanger according to embodiment 2 of the present invention.

As illustrated in FIG. 11, according to embodiment 2 of the present invention, the flat tube groove through holes 3, the distribution channels 11 and the throttling channels 4 are all provided in a single column, each of the distribution channels 11 is provided corresponding to the flat tube groove through holes 3 in two rows, each of the throttling channels 4 is provided corresponding to one distribution channel 11, and the throttling channels 4 here are throttling holes. The structure of the plate-type header pipes at two ends of the flat tubes 8 is the same, thereby forming a single-row single-pass micro-channel heat exchanger.

Figure 12:
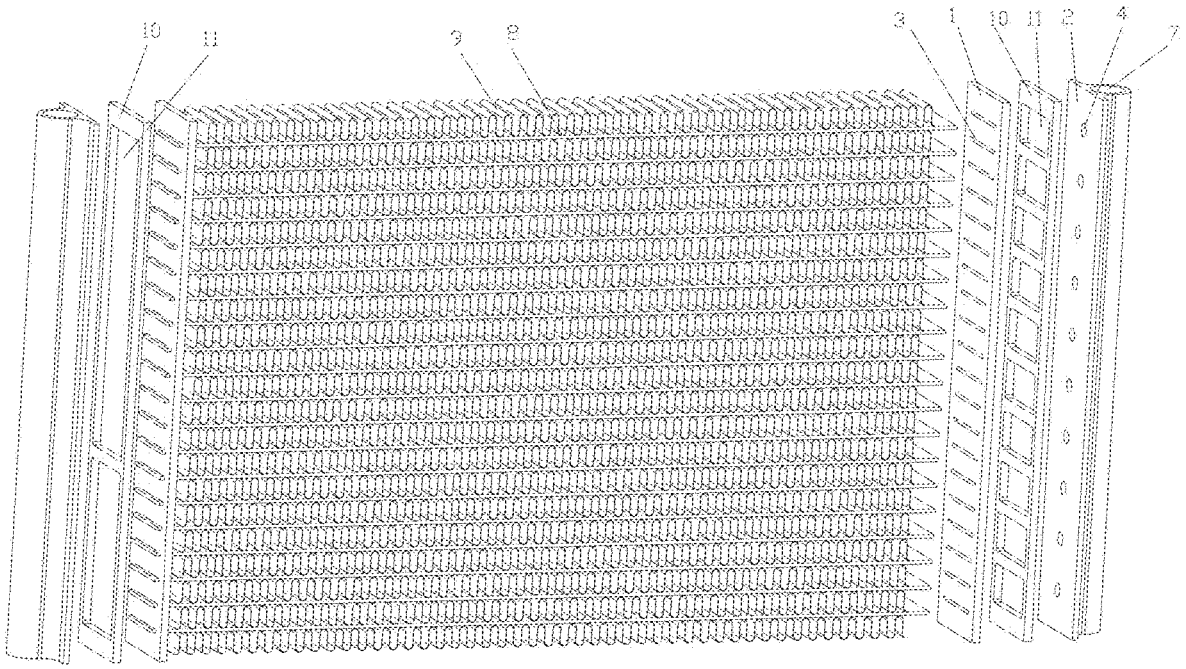
FIG. 12 schematically illustrates an exploded structural view of a micro-channel heat exchanger according to embodiment 3 of the present invention.

As illustrated in FIG. 12, according to embodiment 3 of the present invention, the flat tube groove through holes 3, the distribution channels 11 and the throttling channels 4 are all provided in a single column, each of the distribution channels 11 in the plate-type header pipe at one end of the flat tubes 8 is provided corresponding to the flat tube groove through holes 3 in two rows, each of the throttling channels 4 is provided corresponding to one distribution channel 11, and the throttling channels 4 here are throttling holes. The number of the distribution channels 11 in the plate-type header pipe in the other end of the flat tubes 8 is two, and each of the distribution channels 11 is provided corresponding to the flat tube groove through holes 3 in a plurality of rows, thereby forming a single-row multi-pass micro-channel heat exchanger.

Figure 13:
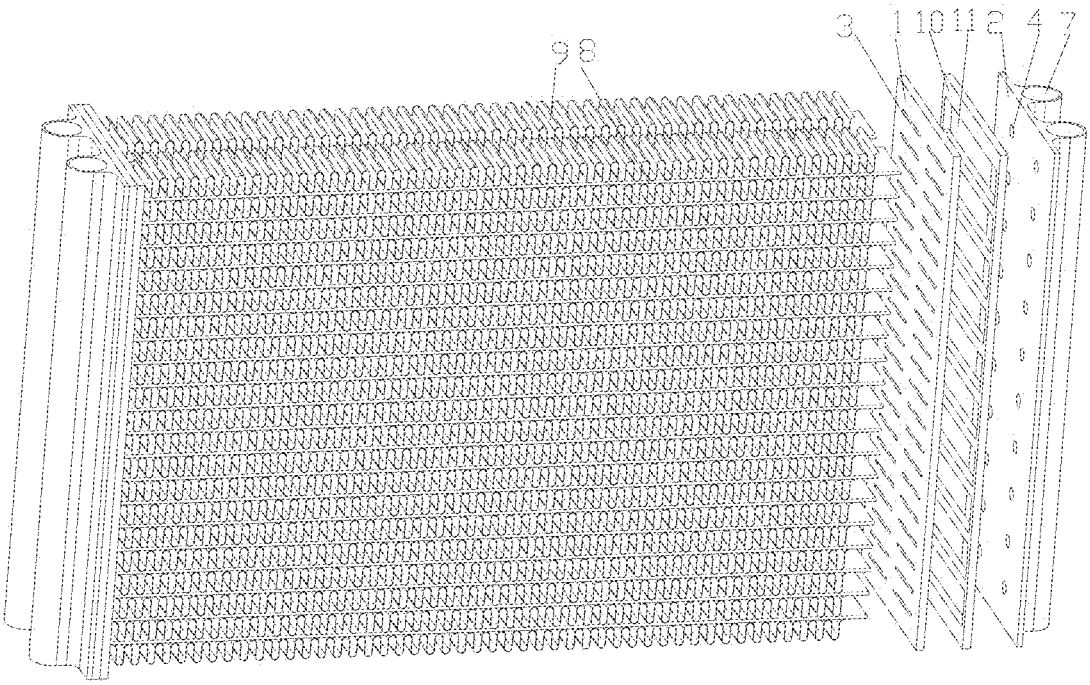
FIG. 13 schematically illustrates an exploded structural view of a micro-channel heat exchanger according to embodiment 4 of the present invention.

As illustrated in FIG. 13, according to embodiment 4 of the present invention, the flat tube groove through holes 3 and the throttling channels 4 are all provided in double columns, the distribution channels 11 are provided in a single column, each of the distribution channels 11 is provided corresponding to the flat tube groove through holes 3 in one row or two rows, each of the throttling channels 4 is provided corresponding to one distribution channel 11, and the throttling channels 4 here are throttling holes. After the refrigerant enters the distribution channels 11 from the throttling channels 4, the refrigerant is fully mixed in the distribution channels 11 and then is uniformly distributed again, such that the refrigerant can be more uniformly distributed into each of the flat tube groove through holes 3 and is further equally distributed into each of the flat tubes 8, and the overall heat exchange efficiency of the micro-channel heat exchanger is improved. The structure of the plate-type header pipes at two ends of the flat tubes 8 is the same, thereby forming a multiple-input multiple-output micro-channel heat exchanger.

As illustrated in FIG. 14, according to embodiment 5 of the present invention, the flat tube groove through holes 3 are provided in double columns, the distribution channels 11 and the throttling channels 4 are all provided in a single column, each of the distribution channels 11 is provided corresponding to the flat tube groove through holes 3 in one row or two rows, each of the throttling channels 4 is provided corresponding to one distribution channel 11, and the throttling channels 4 here are throttling holes. After the refrigerant enters the distribution channels 11 from the throttling channels 4, the refrigerant is fully mixed in the distribution channels 11 and then is uniformly distributed again, such that the refrigerant can be more uniformly distributed into each of the flat tube groove through holes 3 and is further equally distributed into each of the flat tubes 8, and the overall heat exchange efficiency of the micro-channel heat exchanger is improved. The structure of the plate-type header pipes at two ends of the flat tubes 8 is the same, thereby forming a single-input single-output micro-channel heat exchanger.

As illustrated in FIG. 15, according to embodiment 6 of the present invention, the flat tube groove through holes 3, the distribution channels 11 and the throttling channels 4 are all provided in double columns, each of the distribution channels 11 in each column is provided corresponding to the flat tube groove through holes 3 in one row or a plurality of rows, each of the throttling channels 4 is provided corresponding to one distribution channel 11, and the throttling channels 4 here are throttling holes. After the refrigerant enters the distribution channels 11 from the throttling channels 4, the refrigerant is fully mixed in the distribution channels 11 and then is uniformly distributed again, such that the refrigerant can be more uniformly distributed into each of the flat tube groove through holes 3 and is further equally distributed into each of the flat tubes 8, and the overall heat exchange efficiency of the micro-channel heat exchanger is improved. The structure of the plate-type header pipes at two ends of the flat tubes 8 is the same, thereby forming a multiple-input multiple-output micro-channel heat exchanger. In the micro-channel heat exchanger, two distribution channels 11 in the same row are spaced apart through a baffle to satisfy refrigerant flow path demands of two independent refrigeration systems and form a parallel multi-system structure.

Figure 16:
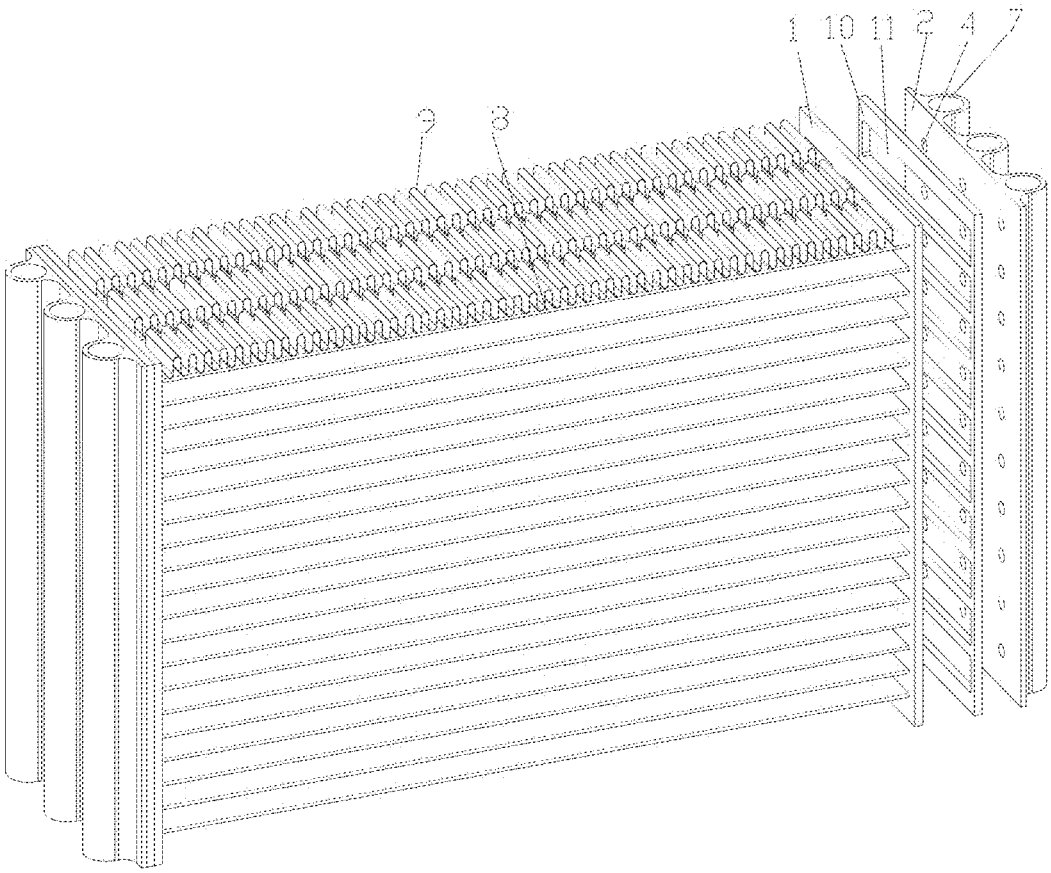
FIG. 16 schematically illustrates an exploded structural view of a micro-channel heat exchanger according to embodiment 7 of the present invention.

As illustrated in FIG. 16, according to embodiment 7 of the present invention, the flat tube groove through holes 3 and the throttling channels 4 are all provided in three columns, the distribution channels 11 are provided in a single column, each of the distribution channels 11 is provided corresponding to the flat tube groove through holes 3 in one row or two rows, three throttling channels 4 in the same row are provided corresponding to one distribution channel 11, and the throttling channels 4 here are throttling holes. After the refrigerant enters the distribution channels 11 from the throttling channels 4, the refrigerant is fully mixed in the distribution channels 11 and then is uniformly distributed again, such that the refrigerant can be more uniformly distributed into each of the flat tube groove through holes 3 and is further equally distributed into each of the flat tubes 8, and the overall heat exchange efficiency of the micro-channel heat exchanger is improved. The structure of the plate-type header pipes at two ends of the flat tubes 8 is the same, thereby forming a single-input single-output micro-channel heat exchanger.

Figure 17:
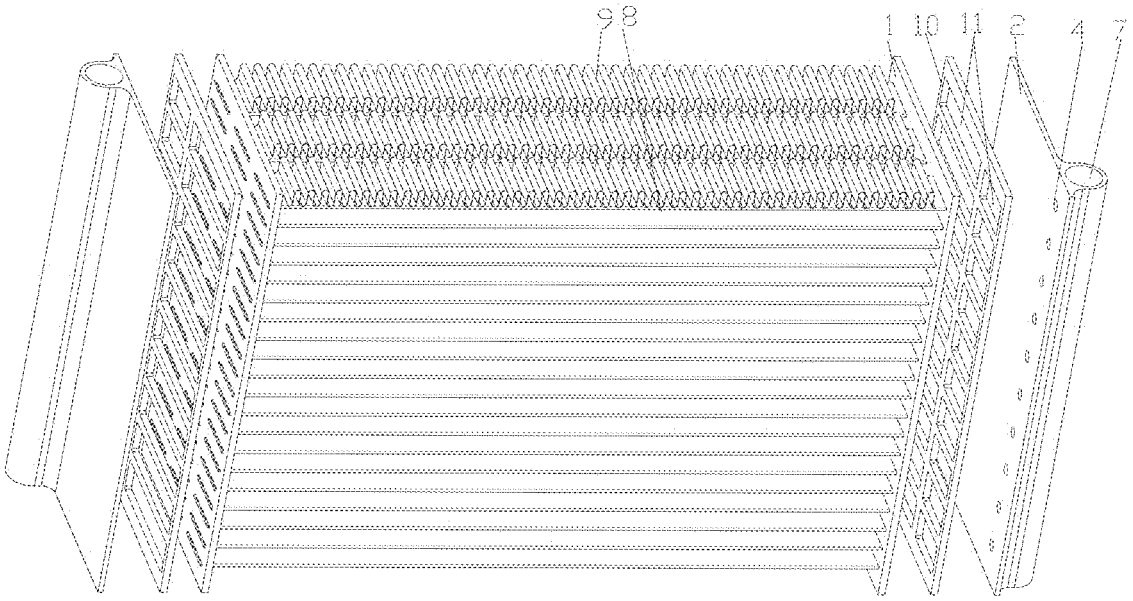
FIG. 17 schematically illustrates an exploded structural view of a micro-channel heat exchanger according to embodiment 8 of the present invention.

As illustrated in FIG. 17, according to embodiment 8 of the present invention, the flat tube groove through holes 3 are provided in three columns, the distribution channels 11 are provided in double columns, the throttling channels 4 are provided in a single column, the distribution channels 11 in a first column are communicated with the flat tube groove through holes 3 in two columns, each of the distribution channels 11 in this column is communicated with two flat tube groove through holes 3 in at least the same row, the distribution channels 11 in a second row are communicated with the flat tube groove through holes 3 in a third column, the throttling channels 4 are communicated with the distribution channels 11 in the other column, and the throttling channels 4 here are throttling holes. After the refrigerant enters the distribution channels 11 from the throttling channels 4, the refrigerant enters the flat tube groove through holes 3 in the third column in the flat tube groove plate 1 from the distribution channels 11 in the second column in the spacing plate 10, then passes through the flat tubes 8 communicated with the flat tube groove through holes 3 in the third column, flows out from the flat tube groove through holes 3 in the third column at the other end of the flat tubes 8, enters the distribution channels 11 in the first column in the spacing plate 10 at the other end of the flat tubes 8, is distributed again, then enters the flat tube groove through holes 3 in the second column which are located in the same distribution channel 11 as the flat tube groove through holes 3 in the third column, then passes through the flat tubes 8 communicated with the flat tube groove through holes 3 in the second column, then flows out from the flat tube groove through holes 3 in the second column at one end of the flat tubes 8, enters the distribution channels 11 in the first column in the spacing plate 10 at one end of the flat tubes 8, then passes through the distribution channels 11 in the first column and the flat tube groove through holes 3 in the first column, enters the distribution channels 11 in the second column in the spacing plate 10 at the other end, passes through the distribution channels 11 in the second column and the throttling channels 4 in the distribution plate 2 at the other end, enters the protruding channel 7 at the other end, and then flows out from the protruding channel 7, thereby forming a multi-row serial micro-channel heat exchanger.

The flat tube groove through holes 3, the distribution channels 11 and the throttling channels 4 may also be combined through other forms to form a dual-row serial micro-channel heat exchanger, a three-row parallel micro-channel heat exchanger, a multiple-input single-output or a single-input multiple-output micro-channel heat exchanger, etc. By changing the positions of the distribution channels 11 and the baffle on the spacing plate 10, a multi-row heat exchanger parallel-plus-serial hybrid structural form may also be realized.

In each of the above-mentioned embodiments, the refrigerant inlet and outlet pipe section area of the protruding channel 7 shall satisfy the requirement that the pipe section area for gas refrigerant is greater than or equal to the pipe section area for liquid refrigerant.

The refrigerant inlet pipe section area of the protruding channel 7 and the total area of all throttling holes or grooves in the distribution plate 2 shall satisfy the following requirement:

(inlet pipe section area)/(total area of throttling holes or grooves)≥1

The refrigerant outlet pipe section area of the protruding channel 7 and the total area of all throttling holes or grooves in the pipe shall satisfy the following requirement:

(outlet pipe section area)/(total area of throttling holes or grooves)≤3

As illustrated in FIGS. 20-23, according to the embodiment of the present invention, a micro-channel heat exchanger comprises flat tubes 8, fins 9 and plate-type header pipes communicated with the flat tubes 8, each of the plate-type header pipes comprises a flat tube groove plate 1 and a distribution plate 2, a plurality of flat tube groove through holes 3 are provided in the flat tube groove plate 1 along a length direction, distribution channels 11 communicated with the flat tube groove through holes 3 are provided in the distribution plate 2 along an arrangement direction of the flat tube groove through holes 3, two flat tube groove through holes 3 in the same row are correspondingly provided, and each of the distribution channels 11 is at least communicated with two flat tube groove through holes 3 in the same row. In this embodiment, the throttling channels are not provided, the distribution channels 11 are only provided, the redistribution of the refrigerant is realized through the distribution channels 11, thus the distributed refrigerant is prevented from being distributed for a second time in the plate-type header pipes and the refrigerant distribution performance of the micro-channel heat exchanger is greatly improved.

Figure 20:
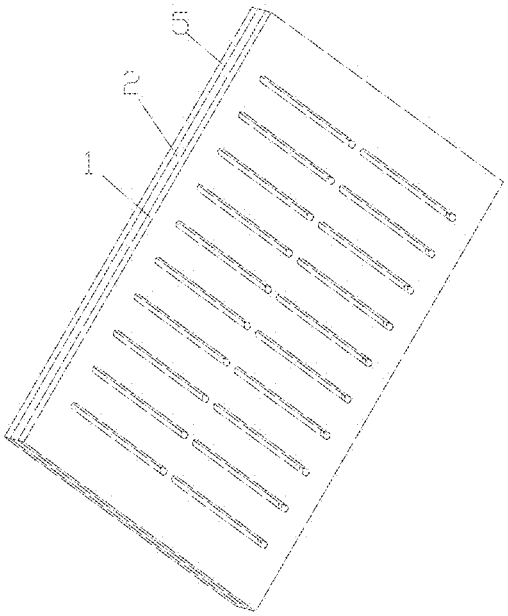
FIG. 20 schematically illustrates a stereoscopic structural view of a plate-type header pipe of a micro-channel heat exchanger according to embodiment 9 of the present invention.
Figure 21:
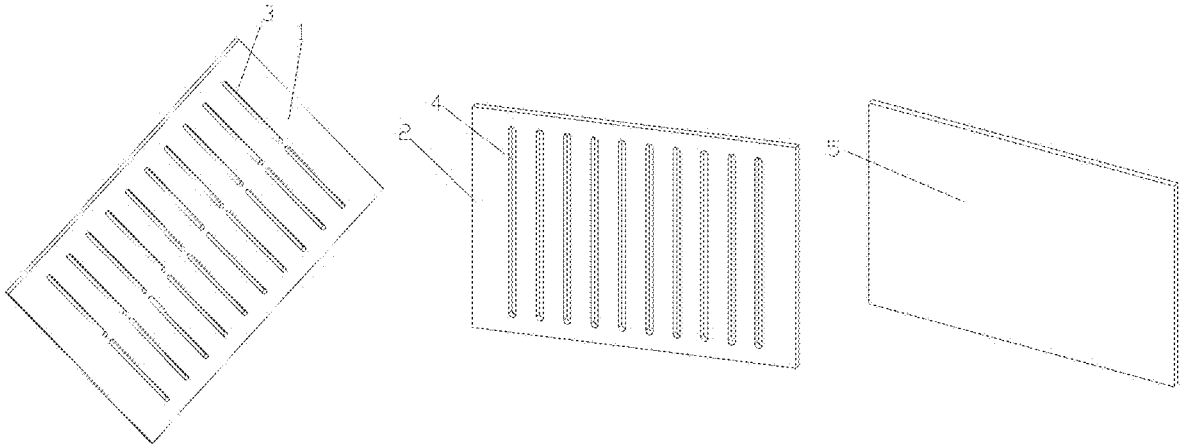
FIG. 21 schematically illustrates an exploded structural view of a plate-type header pipe of a micro-channel heat exchanger according to embodiment 9 of the present invention.

As illustrated in FIG. 20 and FIG. 21, according to embodiment 9 of the present invention, in this embodiment, every two of flat tube groove through holes 3 in two columns in each of the plate-type header pipes are provided in a row and are correspondingly abreast provided one to one, an outer side sealing plate 5 is provided outside one side, far away from the flat tube groove through holes 3, of the distribution plate 2, the distribution channels 11 are distribution grooves, the distribution grooves are provided in the distribution plate 2 in a run-through manner and are communicated with the flat tube groove through holes 3 in at least one row, and the outer side sealing plate 5 seals outer sides of the distribution grooves. The refrigerant flows into the distribution channel 11 in the distribution plate 2 from one flat tube groove through hole 3 in the same row, then passes the distribution channel 11, enters the other flat tube groove through hole 3 in the same row, passes through the other flat tube groove through hole 3 and enters the corresponding flat tube, thereby realizing the serial flow of the refrigerant. Each of the distribution channels 11 may be provided corresponding to flat tube groove through holes 3 in one row and may also be provided corresponding to flat tube groove through holes 3 in a plurality of rows, such that the redistribution of the refrigerant is better realized and the uniform distribution efficiency of the refrigerant is improved.

Figure 22:
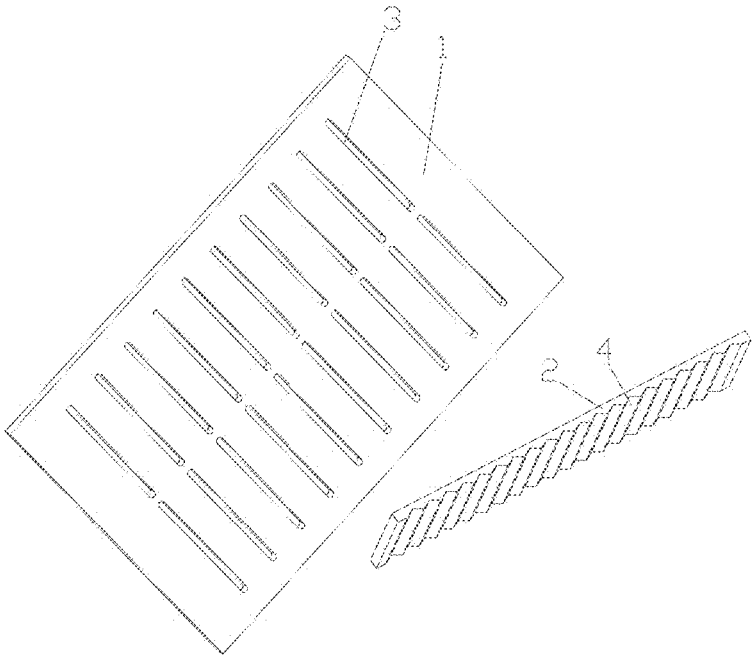
FIG. 22 schematically illustrates an exploded structural view of a plate-type header pipe of a micro-channel heat exchanger according to embodiment 10 of the present invention.

As illustrated in FIG. 22, according to embodiment 10 of the present invention, the plate-type header pipe is suitable for a double-column serial flat tube structure. In this embodiment, the flat tube groove through holes 3 in two columns are correspondingly abreast arranged one to one, the distribution channels 11 are toothed grooves 6 which are provided in one side, facing to the flat tube groove plate 1, of the distribution plate 2 and extend along a width direction of the distribution plate 2, and each of the toothed grooves 6 is communicated with the flat tube groove through holes 3 in at least one row. In this embodiment, sealing is realized directly through a bottom plate of the toothed grooves 6 and thus a separate outer side sealing plate does not need to be provided. In this embodiment, the toothed grooves 6 play a role of communicating two flat tube groove through holes 3 in at least the same row such that the two serial flat tubes are communicated. Of source, the width of the toothed grooves 6 may be adjusted such that the same toothed groove 6 can simultaneously realize intercommunication of flat tubes in two rows or more rows, so as to realize the uniform distribution of the refrigerant.

Figure 23:
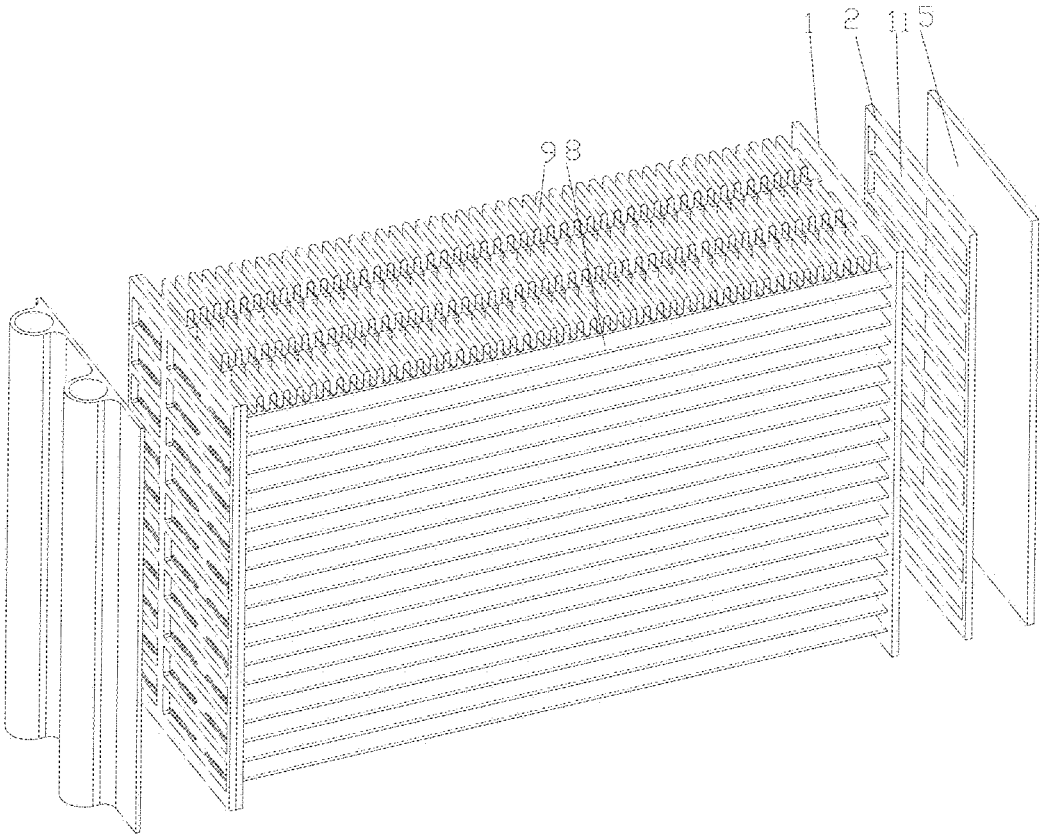
FIG. 23 schematically illustrates an exploded structural view of a micro-channel heat exchanger according to embodiment 11 of the present invention.

As illustrated in FIG. 23, according to embodiment 11 of the present invention, it is substantially the same as embodiment 9 and a difference lies in that the micro-channel heat exchanger has flat tubes 8 in three rows in this embodiment. The structure of the plate-type header pipe at one end of the flat tubes 8 of the micro-channel heat exchanger is the same as the structure in embodiment 9, the structure of the plate-type header pipe at the other end comprises a spacing plate 10 and an integrated distribution plate 2 and a protruding channel 7, and the specific structural form thereof may be designed in combination with the above-mentioned embodiments. By adopting this structure, a multi-row heat exchanger parallel-plus-serial hybrid structural form can be conveniently realized and the diversification of the micro-channel heat exchanger is improved.

Figure 24:
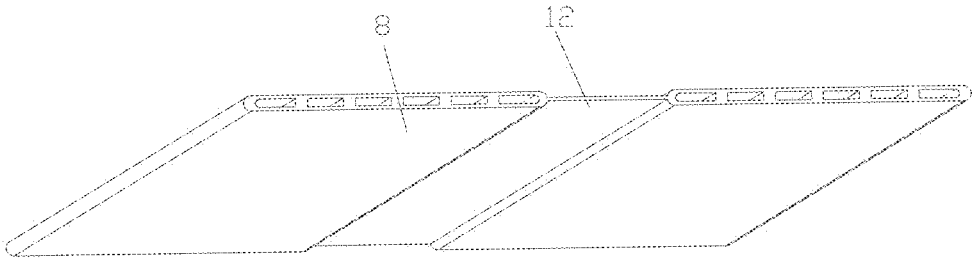
FIG. 24 schematically illustrates a stereoscopic structural schematic view of a flat tube of a micro-channel heat exchanger according to the present invention.

As illustrated in FIG. 24, according to the embodiment of the present invention, for a double-row micro-channel heat exchanger, the flat tubes and the fins may be designed to be integral, i.e., the flat tubes are designed to be in two columns between which a connecting rib 12 is provided, and the fins are designed to have double-row width, so as to improve the integration level of the flat tube and fin molding structure.

The micro-channel heat exchanger provided by the present invention has the following advantages:

1. By adopting the plate-type header pipe, the space can be saved, the cost is reduced and the manufacturing process is simple.

2. The flowing channel in the plate-type header pipe is small and the pressure bearing capability is strong; and after the flowing channel is reduced, the gas and liquid refrigerant is not easily separated and the uniform distribution of the refrigerant is facilitated.

3. By designing the size and shape of and the distance between the throttling holes, the flowing resistance between different flat tubes is balanced and the refrigerant is enabled to be more uniformly distributed.

4. For a double-row/multi-row heat exchanger, additional connecting pipelines are not needed such that the structure of the heat exchanger is enabled to become simple; and by designing the flat tubes and the fins into an integral body, the assembling efficiency during production can be greatly improved.

5. For a single-row heat exchanger, no additional baffle is required and the risk of baffle bypass is avoided.

6. For a multi-row serial-plus-parallel hybrid structure, the demand that the front and rear section area of the flow path of the refrigerant is different can be satisfied, so as to be adaptive to the change of specific volume after phase change of the refrigerant and reduce the flowing resistance.

The above-mentioned embodiments are just preferred embodiments of the present invention and are not used for limiting the present invention. For one skilled in the art, various modifications and changes can be made to the present invention. Any modification, equivalent replacement, improvement and the like made within the spirit and principle of the present invention shall be all included in the protection scope of the present invention.

The invention claimed is:

1. A micro-channel heat exchanger, wherein the micro-channel heat exchanger comprises flat tubes (8), fins (9) and plate-type header pipes communicated with the flat tubes (8), each of the plate-type header pipes comprises a flat tube groove plate (1), a distribution plate (2) and an outer side sealing plate (5), a plurality of flat tube groove through holes (3) are provided in the flat tube groove plate (1) along a length direction, throttling channels (4) communicated with the flat tube groove through holes (3) are provided in the distribution plate (2) along an arrangement direction of the flat tube groove through holes (3), the outer side sealing plate (5) is provided on one side, far away from the flat tube groove plate (1), of the distribution plate (2), the outer side sealing plate (5) comprises a protruding channel (7) protruding from the outer side sealing plate (5) in a direction away from the distribution plate (2) and extending along an arrangement direction of the throttling channels (4), and the protruding channel (7) is communicated with at least part of the throttling channels (4) in the same column, wherein toothed grooves (6) extending along a length direction of the distribution plate (2) are provided in one side, facing to the flat tube groove plate (1), of the distribution plate (2), and the throttling channels (4) run through a bottom plate of the toothed grooves (6).

2. The micro-channel heat exchanger according to claim 1, wherein the throttling channels (4) comprise distribution holes or distribution grooves which are provided corresponding to the flat tube groove through holes (3).

3. The micro-channel heat exchanger according to claim 2, wherein the flat tube groove through holes (3) are provided in a single column or a plurality of columns, and when the flat tube groove through holes (3) are provided in a plurality of columns, the width of the flat tube groove through holes (3) in the plurality of columns is the same or different.

* * * * *